US007285024B1

(12) United States Patent
Tai

(10) Patent No.: US 7,285,024 B1
(45) Date of Patent: Oct. 23, 2007

(54) AUDIO JACK CONNECTOR

(75) Inventor: Yu-Shen Tai, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 11/308,479

(22) Filed: Mar. 29, 2006

(51) Int. Cl.
*H01R 24/04* (2006.01)

(52) U.S. Cl. ..... 439/668; 439/188

(58) Field of Classification Search ..... 439/668, 439/669, 188
See application file for complete search history.

(56) References Cited

U.S. PATENT DOCUMENTS

| | | | | |
|---|---|---|---|---|
| 5,338,215 | A * | 8/1994 | Lee et al. | 439/188 |
| 6,220,899 | B1 * | 4/2001 | Suzuki | 439/675 |
| 6,270,380 | B1 * | 8/2001 | Shichida et al. | 439/669 |
| 6,319,030 | B1 * | 11/2001 | Wu | 439/188 |
| 6,368,156 | B1 * | 4/2002 | Lin | 439/668 |
| 6,382,999 | B1 * | 5/2002 | Mou et al. | 439/188 |
| 6,595,804 | B2 * | 7/2003 | Nagata | 439/668 |
| 6,869,315 | B2 * | 3/2005 | Nakai et al. | 439/668 |
| 6,991,497 | B1 * | 1/2006 | Lin | 439/668 |
| 7,056,141 | B2 * | 6/2006 | Moffett et al. | 439/346 |
| 2003/0119368 | A1 * | 6/2003 | Li et al. | 439/668 |

* cited by examiner

*Primary Examiner*—Gary F. Paumen
(74) *Attorney, Agent, or Firm*—Jianq Chyun IP Office

(57) ABSTRACT

An audio jack connector suitable for connecting with a plug is provided. The audio jack connector includes an insulating housing, a first contact terminal, a second contact terminal, a plurality of third contact terminals, a first fixing plate, and a second fixing plate. The insulating housing includes an inserting hole, a chamber, and a plurality of grooves. The inserting hole is connected through to the chamber. The grooves are disposed on the sidewalls of the chamber and connected through to the chamber. The first/second/third contact terminal is disposed in one of the corresponding grooves. The first/second fixing plate is electrically connected to the first/second contact terminal and is disposed in one of the corresponding grooves. As a plug is inserted into the chamber, the first/second/third contact terminal is electrically connected to the plug. At the same time, the first/second contact terminal detaches from the first/second fixing plate.

9 Claims, 8 Drawing Sheets

AUDIO JACK CONNECTOR

BACKGROUND OF THE INVENTION

1. Field of the Invention

The present invention relates to a connector. More particularly, the present invention relates to an audio jack connector.

2. Description of the Related Art

With the big advances in technologies, electronic products are designed with lightweight and streamline bodies so that they can be carried around with ease. For example, recent electronic products including the MP3, the mobile phones and the personal digital assistants (PDA) all follow this trend. Moreover, for most electronic products' users, the convenience of listening to voice data through an earphone has almost become essential. Therefore, most electronic products have an audio jack connector disposed thereon for receiving the audio plug of an earphone. With this audio jack connector, the user can listen to the audio signals delivered through the electronic product.

FIG. 1 is a perspective view showing all the major components of a conventional audio jack connector. FIG. 2 is a bottom view of a conventional audio jack connector. FIG. 3 is a bottom cross-sectional view of a conventional audio jack connector. As shown in FIGS. 1, 2 and 3, the conventional audio jack connector 100 includes a first contact terminal 110, a second contact terminal 120, a third contact terminal 130, a fourth contact terminal 140, a first fixing plate 150, a second fixing plate 160 and an insulating housing 170. The insulating housing 170 has a chamber 172 and a plurality of grooves 174 (five are shown in FIG. 2). The grooves 174 are disposed on the sidewalls of the chamber 172 and connected through the chamber 172. The first contact terminal 110, the second contact terminal 120 and the third contact terminal 130 are disposed in a corresponding groove 174 respectively. The first fixing plate 150 and the second fixing plate 160 are similarly disposed in a corresponding groove 174 for fixing the first contact terminal 110 and the second contact terminal 120 respectively.

The conventional fourth contact terminal 140 is a 'π'-shaped spring plate with each side having a latching groove 142. Each latching groove 142 latches with a latching block 176 on the surface of the insulating housing 170 (only one side is shown in FIG. 1) so that the fourth contact terminal 140 can lock tightly to the insulating housing 170. In addition, the fourth contact terminal 140 also has a spring plate portion 144. The spring plate portion 144 extends from an opening 178 on the insulating housing 170 into the chamber 172. Therefore, when the audio plug (not shown) of an earphone is plugged into the chamber 172 of an audio jack connector 100 of an electronic product, the contact terminals 110, 120, 130 and 140 are electrically connected to the audio plug (not shown). Moreover, the aforementioned contact terminals 110, 120, 130 and 140 are all electrically connected to an audio circuit board (not shown) inside the electronic product so that a user can listen to the audio information provided by the electronic product through the earphone.

In order to match the structural design of the conventional audio jack connector, some contact terminals are directly disposed in their respective grooves (like the first contact terminal, the second contact terminal and the third contact terminal). However, the contact terminals with a latching groove are directly latched to the insulating housing (like the fourth contact terminal). Therefore, the conventional design demands a longer period to assemble each and every one contact terminal to the insulating housing. In other words, the conventional audio jack connector has a higher production cost.

The assembling of the fourth contact terminal to the insulating housing of a conventional audio jack connector differs from other contact terminals (the fourth contact terminal needs to latch onto a latching block on the surface of the insulating housing). When the latching groove on the contact terminal or the latching block on the insulating housing is not manufactured precisely enough, the fourth contact terminal will not latch accurately to the insulating housing. As a result, the height of the connecting lead of the fourth contact terminal may differ from the other contact terminals. In other words, the connecting leads of the contact terminals of the audio jack connector will have non-uniform planarity. When the audio jack connector is joined to a circuit board inside the electronic product, some of the terminal leads may not form an effective electrical connection with the circuit board so that the signal quality may be adversely affected.

SUMMARY OF THE INVENTION

Accordingly, at least one objective of the present invention is to provide an audio jack connector with a structural design capable of reducing assembling time.

At least another objective of the present invention is to provide an audio jack connector having a structural design capable of increasing overall production yield.

To achieve these and other advantages and in accordance with the purpose of the invention, as embodied and broadly described herein, the invention provides an audio jack connector suitable for connecting with a plug. The audio jack connector includes an insulating housing, a first contact terminal, a second contact terminal, a plurality of third contact terminals, a first fixing plate, and a second fixing plate. The insulating housing has an inserting hole, a chamber, and a plurality of grooves. The inserting hole is connected to the chamber. The grooves are disposed on the sidewalls of the chamber and connected through to the chamber. The first/second contact terminal is disposed in one of the corresponding grooves respectively. The third contact terminals are similarly disposed in the grooves. The first/second fixing plate is electrically connected to the first/second contact terminal and is disposed in one of the corresponding grooves respectively.

When the aforementioned plug is inserted into the chamber, the first contact terminal, the second contact terminal and the plurality of third contact terminals are electrically connected to the plug. Furthermore, the first contact terminal and the second contact terminal detach from the first fixing plate and the second fixing plate respectively.

In one embodiment of the present invention, the first contact terminal includes a first terminal body, a first spring contact arm and a first terminal connecting lead. The first spring contact arm extends out from the first terminal body and has a bending portion and a first contact portion. The first contact portion and the first fixing plate are electrically connected, and the bending portion is located inside the chamber suitable for contacting with the plug. The first terminal connecting lead bends out from the first terminal body. Therefore, when the plug is inserted into the chamber, the plug will push against and move the bending portion so that the first contact portion detaches from the first fixing plate. Moreover, the first terminal body has a latching plate.

Furthermore, the insulating housing has a corresponding latching groove that can engage with the latching plate. Hence, the latching plate can latch onto the latching groove, for example.

In one embodiment of the present invention, the first fixing plate includes a first fixing body, a first stopping portion and a first fixing plate connecting lead. The first stopping portion extends from the first fixing body. The first contact portion is limited to move within the outer edge of the first stopping portion, and the first fixing plate connecting lead bends out from the first fixing body.

In one embodiment of the present invention, the second contact terminal includes a second terminal body, a second spring contact arm and a second terminal connecting lead. The second spring contact arm extends from the second terminal body and has a second contact portion and a first contact protrusion. The second contact portion and the second fixing plate are electrically connected, and the first contact protrusion is disposed in the chamber and is adapted to contact the plug. The second terminal connecting lead bends out from the second terminal body. Therefore, when the plug is inserted into the chamber, the plug will push against and move the first contact protrusion so that the second contact portion detaches from the second fixing plate.

In one embodiment of the present invention, the second fixing plate includes a second fixing body, a second stopping portion and a second fixing plate connecting lead. The second stopping portion extends from the second fixing body. Furthermore, the second contact portion is limited to move within the outer edge of the second stopping portion. The second fixing plate connecting lead bends out from the second fixing body.

In one embodiment of the present invention, each third contact terminal includes a third terminal body, a third spring contact arm and a third terminal connecting lead. The third spring contact arm extends from the third terminal body and has a second contact protrusion. The second contact protrusion is disposed in the chamber and is adapted to contact the plug. The third terminal connecting lead bends out from the third terminal body.

In one embodiment of the present invention, the insulating housing further includes at least an alignment pillar disposed at the bottom of the insulating housing.

In one embodiment of the present invention, the first contact terminal, the second contact terminal, the third contact terminals, the first fixing plate and the second fixing plate are fabricated using titanium-copper alloy, for example.

Accordingly, the contact terminals of the audio jack connector in the present invention are disposed in the grooves on the sidewalls of the chamber. Thus, the assembling process only requires pressing these contact terminals directly into the grooves. Compared with the conventional technique, the audio jack connector in the present invention requires considerably less time in the assembling process. Moreover, a fixture can be used to press the contact terminals into the grooves. Hence, the horizontal height of the terminal connecting leads can be adjusted so that an effective electrical connection of the connecting lead of each contact terminal to the circuit board inside the electronic product is obtained.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
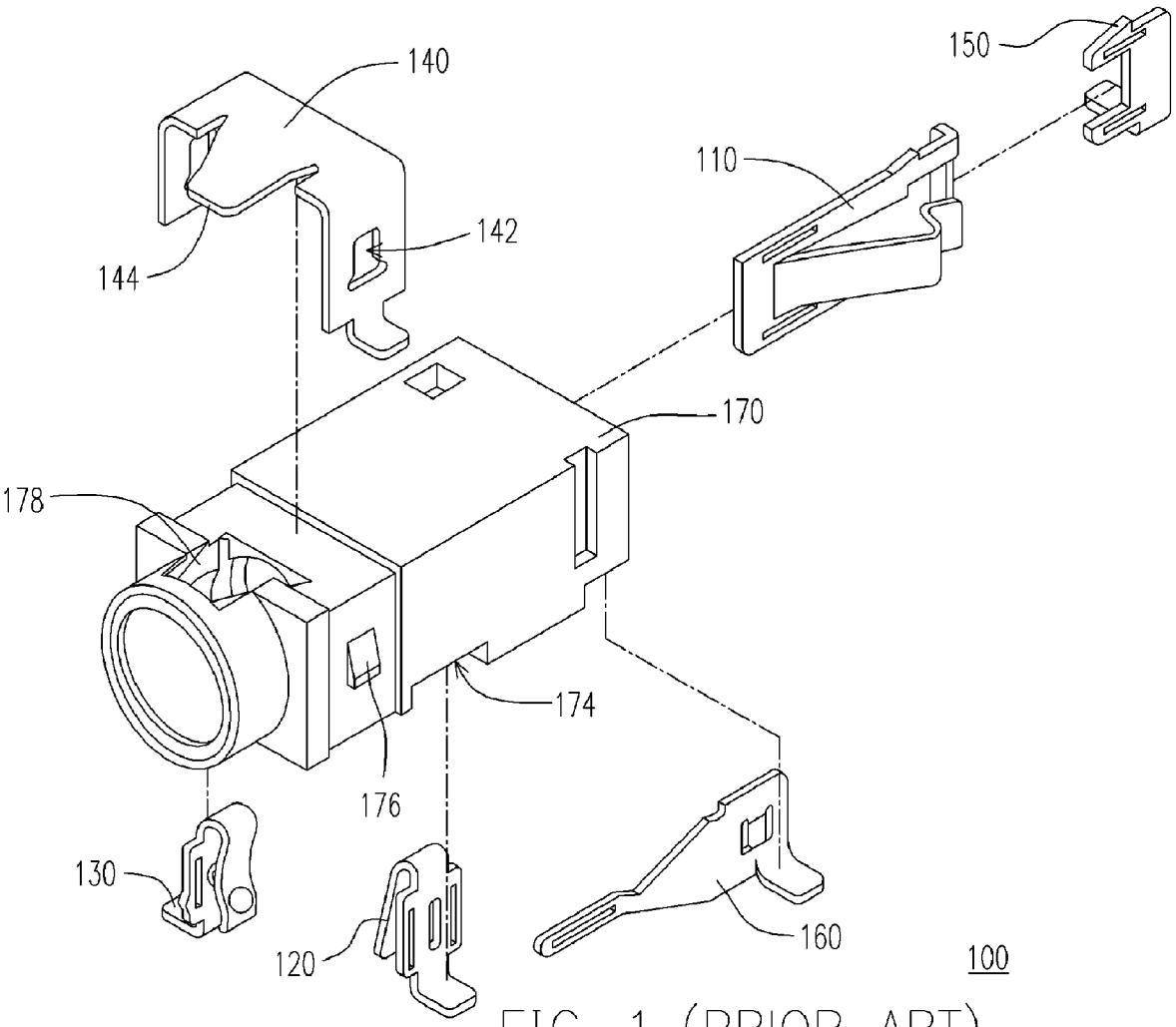
FIG. 1 (PRIOR ART)
FIG. 1 is a perspective view showing all the major components of a conventional audio jack connector.
Figure 2:
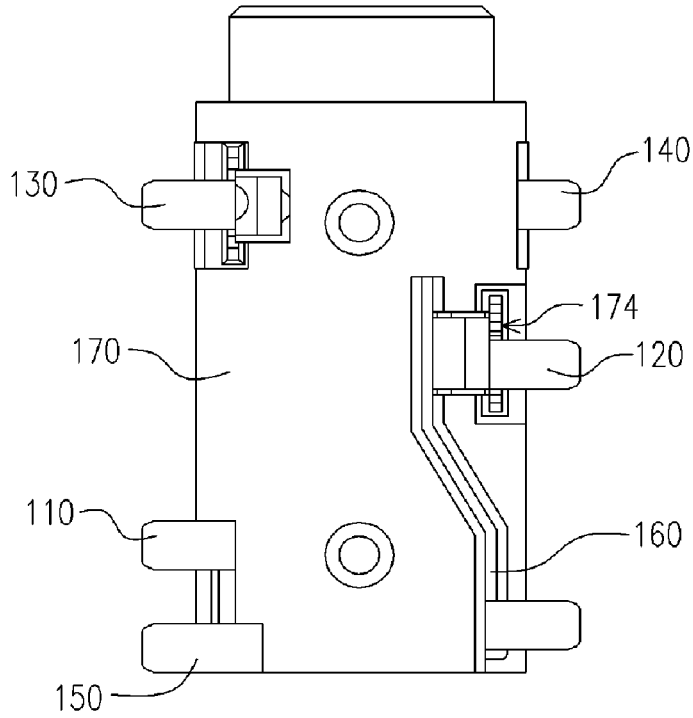
FIG. 2 (PRIOR ART)
FIG. 2 is a bottom view of a conventional audio jack connector.
Figure 3:
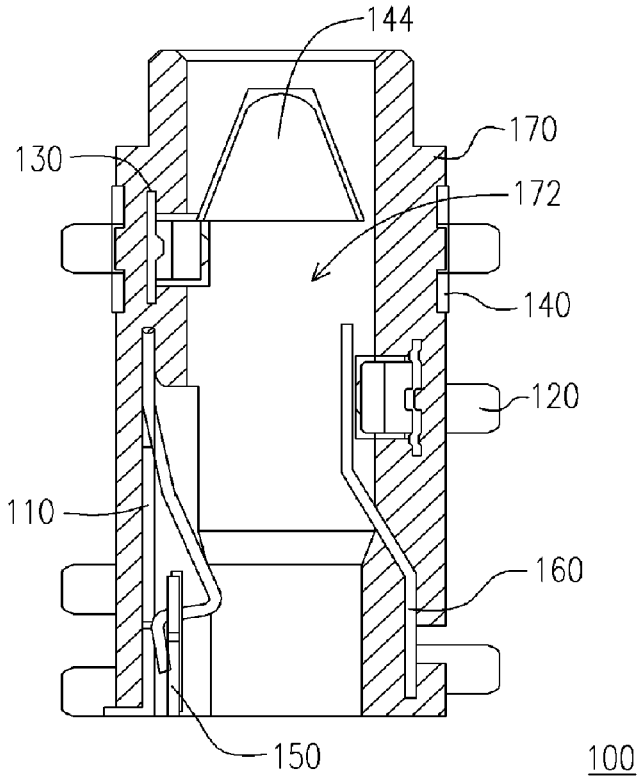
FIG. 3 (PRIOR ART)
FIG. 3 is a bottom cross-sectional view of a conventional audio jack connector.

Reference will now be made in detail to the present preferred embodiments of the invention, examples of which are illustrated in the accompanying drawings. Wherever possible, the same reference numbers are used in the drawings and the description to refer to the same or like parts.

Figure 4:
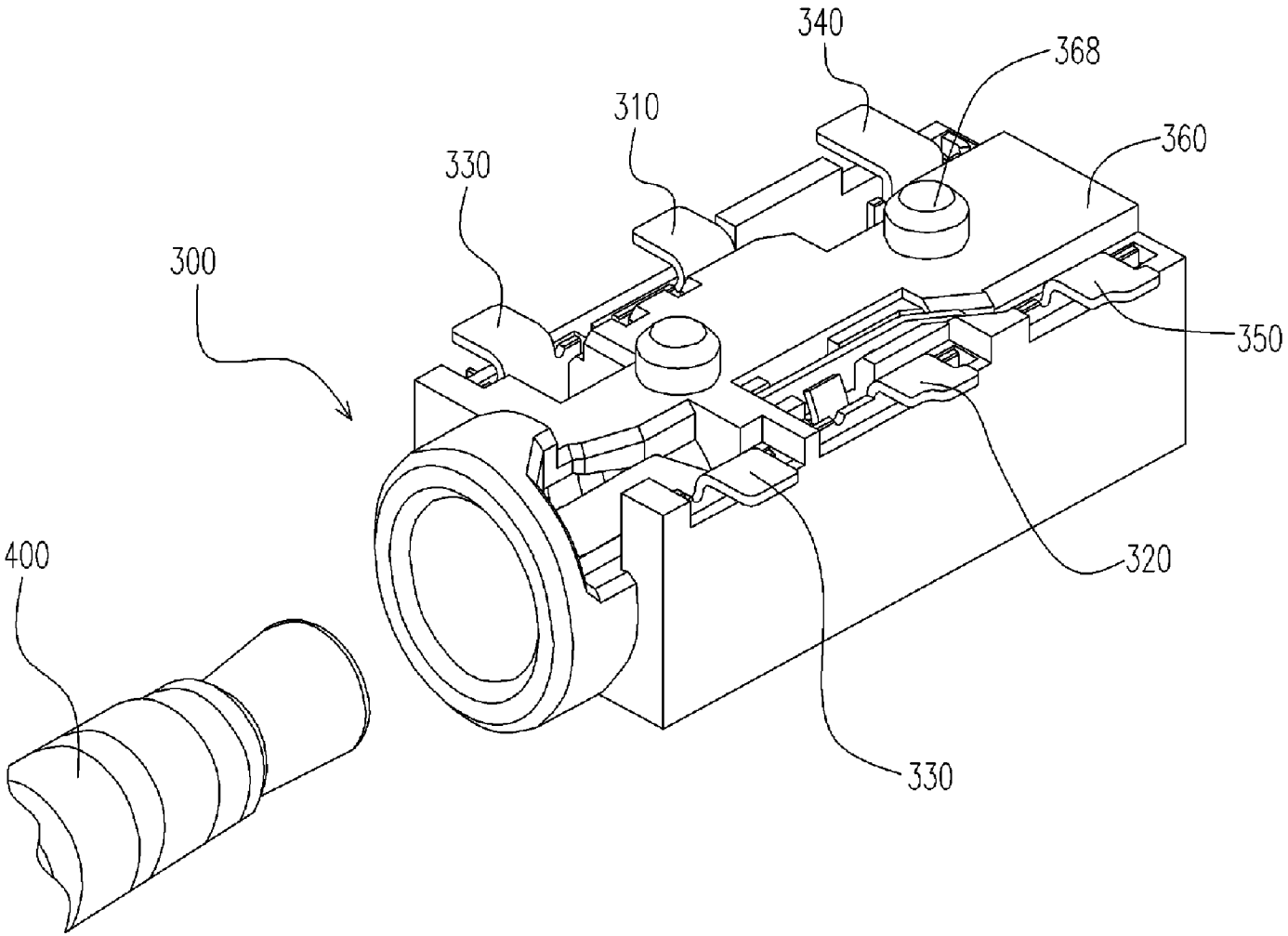
FIG. 4 is a perspective view of an audio jack connector according to one preferred embodiment of the present invention.

The audio jack connector according to the present invention is suitable for disposing inside an electronic product including an MP3, a mobile phone or a personal digital assistant (PDA) so that a user can listen to sound messages provided by the electronic device. FIG. 4 is a perspective view of an audio jack connector according to one preferred embodiment of the present invention. As shown in FIG. 4, the audio jack connector 300 according to the present embodiment is suitable for engaging with a plug 400. The audio jack connector 300 includes a first contact terminal 310, a second contact terminal 320, a plurality of third contact terminals 330 (only two is shown in FIG. 4), a first fixing plate 340, a second fixing plate 350 and an insulating housing 360. The first contact terminal 310, the second contact terminal 320, the third contact terminals 330, the first fixing plate 340 and the second fixing plate 350 are fabricated using titanium-copper alloy, for example.

Figure 5:
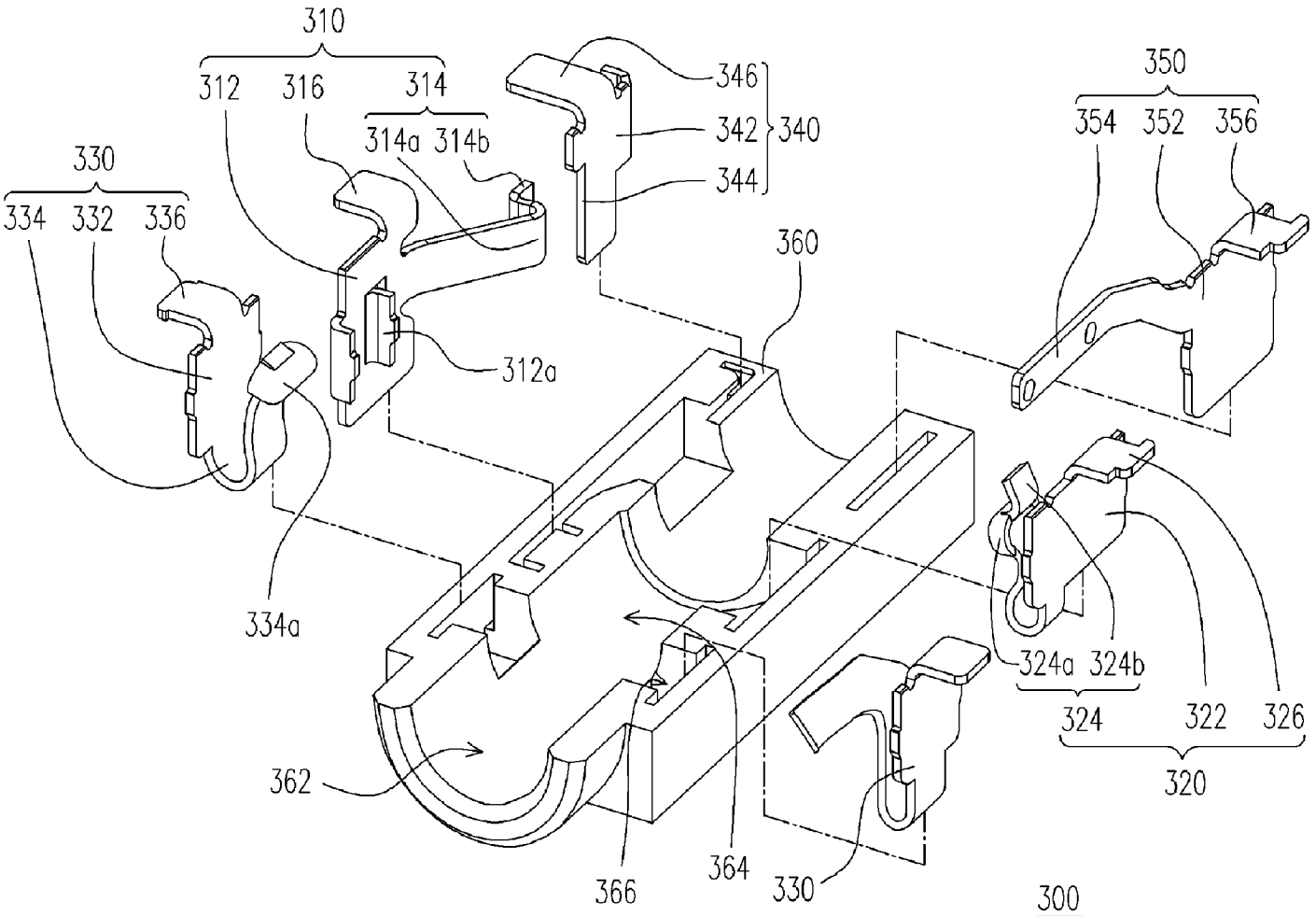
FIG. 5 is a perspective view showing various components of an audio jack connector after removing a portion of the insulating housing according to one preferred embodiment of the present invention.
Figure 6:
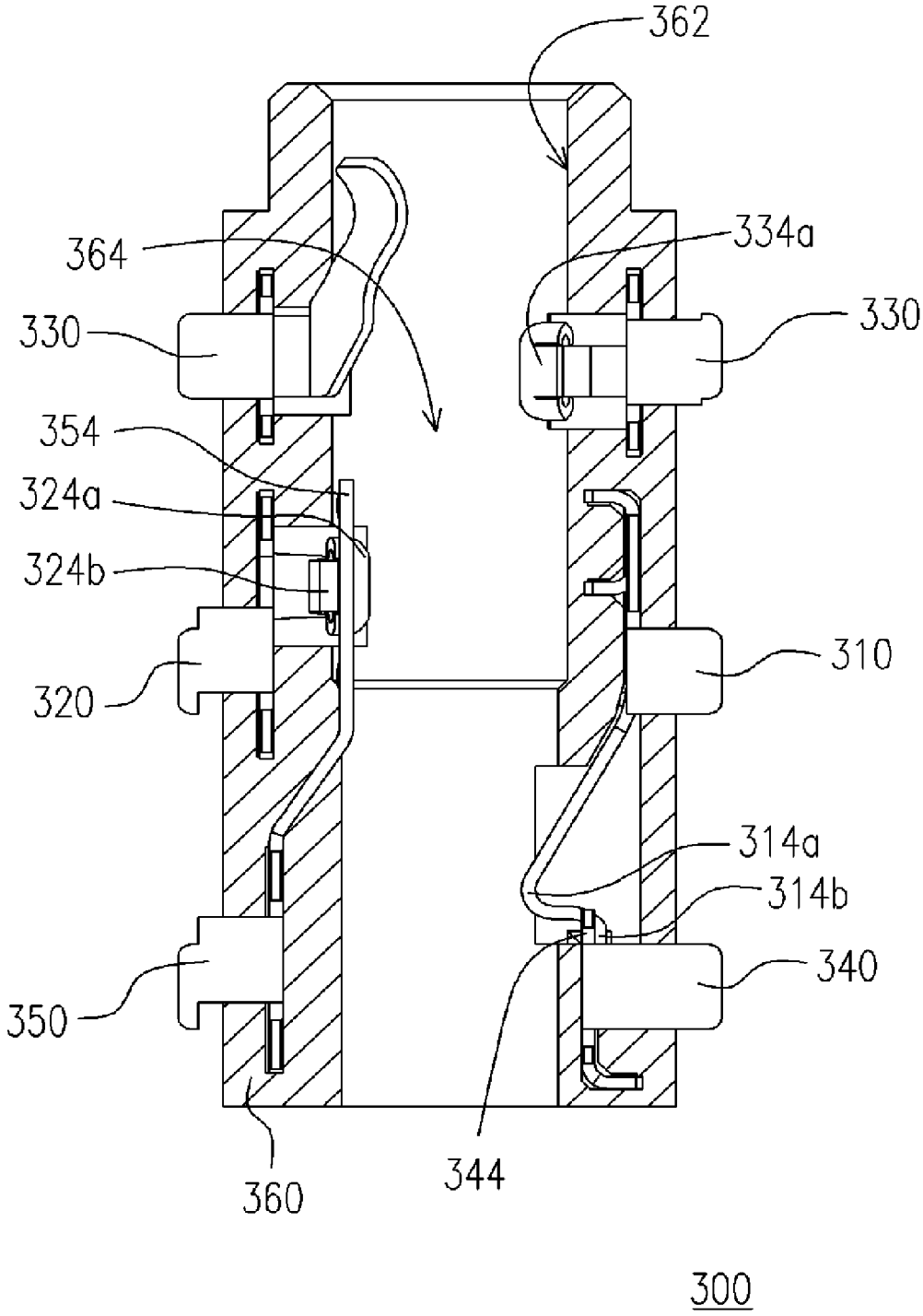
FIG. 6 is a bottom cross-sectional view of an audio jack connector according to one preferred embodiment of the present invention.

FIG. 5 is a perspective view showing various components of an audio jack connector after removing a portion of the insulating housing according to one preferred embodiment of the present invention. FIG. 6 is a bottom cross-sectional view of an audio jack connector according to one preferred embodiment of the present invention. As shown in FIGS. 5 and 6, the insulating housing 360 has an inserting hole 362, a chamber 364 and a plurality of grooves 366 (six are shown in FIG. 5). The inserting hole 362 is connected to the chamber 364. The grooves 366 are disposed on the sidewalls of the chamber 364 and connected through to the chamber 364. Therefore, the plug 400 (refer to FIG. 4) can plug into the inserting hole 362 and accommodated inside the chamber 364. In addition, the first, second and third contact terminals 310, 320 and 330 in the present invention is disposed inside a corresponding groove 336 respectively. The first and second fixing plates 340 and 350 are electrically connected to the first and second contact terminals 310 and 320 and are disposed in the groove 366 to correspond with the first and second contact terminal 310 and 320 respectively.

The foregoing description mainly explains the location of the major components in the audio jack connector 300. In the following, the shape of each component is described in more detail.

In the present embodiment, the first contact terminal 310 comprises a first terminal body 312 and a first spring contact arm 314, for example. The first spring contact arm 314 extends from the first terminal body 312 and has a bending portion 314*a* and a first contact portion 314*b*. The first contact portion 314*b* and the first fixing plate 340 are electrically connected. The bending portion 314*a* is disposed inside the chamber 364 and is adapted to contact the plug 400 (refer to FIG. 4). Furthermore, the first terminal body 312 has a latching plate 312*a* and the insulating housing 360 has a latching groove (not shown) that corresponds to the latching plate 312*a*, for example. The latching plate 312*a* can latch onto the latching groove so that the first contact terminal 310 is tightly locked inside the groove 366. In addition, the first fixing plate 340 for fixing the first contact terminal 310 comprises a first fixing body 342 and a first stopping portion 344, for example. The first stopping portion 344 extends from the first fixing body 342 and the first contact portion 314*b* of the first contact terminal 310 is limited to move within the outer edge of the first stopping portion 344.

On the other hand, the second contact terminal 320 comprises a second terminal body 322 and a second spring contact arm 324, for example. The second spring contact arm 324 extends from the second terminal body 322 and has a first contact protrusion 324*a* and a second contact portion 324*b*. The second contact portion 324*b* is electrically connected to the second fixing plate 350. The first contact protrusion 324*a* is disposed inside the chamber 364 and is adapted to contact the plug 400. In addition, the second fixing plate 350 for fixing the second contact terminal 320 comprises a second fixing body 352 and a second stopping portion 354. The second stopping portion 354 extends from the second fixing body 352. The second contact portion 324*b* of the second contact terminal 320 is limited to move within the outer edge of the second stopping portion 354.

The third contact terminal 330 in the present embodiment is an R-shaped component, for example. The third contact terminal 330 mainly comprises a third terminal body 332 and a third spring contact arm 334. The third spring contact arm 334 extends from the third terminal body 332 and has a second contact protrusion 334*a*. The second contact protrusion 334*a* is disposed within the chamber 364 and is adapted to contact the plug 400.

The side edge of the foregoing first, second and third terminal bodies 312, 322 and 332 have a plurality of latching structures (not shown), for example. The first, second and third terminal bodies 312, 322 and 332 are tightly latched to the groove 366 through the latching structures (not shown). Obviously, the first and second fixing plate bodies 342 and 352 are also tightly latched to the groove 366 through the latching structures (not shown). In one preferred embodiment, the insulating housing 360 further includes one or more alignment pillars 368 (refer to FIG. 4) disposed at the bottom of the insulating housing 360. The audio jack connector 300 can be correctly positioned on the circuit board (not shown) in the interior of the electronic product through the alignment pillars 368.

In addition, to facilitate the electrical connection between the audio jack connector 300 and the circuit board (not shown) inside the electronic product, the first, second and third terminal bodies 312, 322 and 332 of the present embodiment can bend out the first, second and third terminal connecting leads 316, 326 and 336. Similarly, the first and second fixing plate bodies 342 and 352 can bend out a first fixing plate connecting lead 346 and a second fixing plate connecting lead 356. Therefore, the audio jack connector 300 can use surface mount technology (SMT) to connect the terminal connecting leads (the first/second/third terminal connecting leads 316/326/336) and the fixing plate connecting leads (the first/second fixing plate connecting lead 346/356) to the circuit board (not shown) inside the electronic product.

Figure 7:
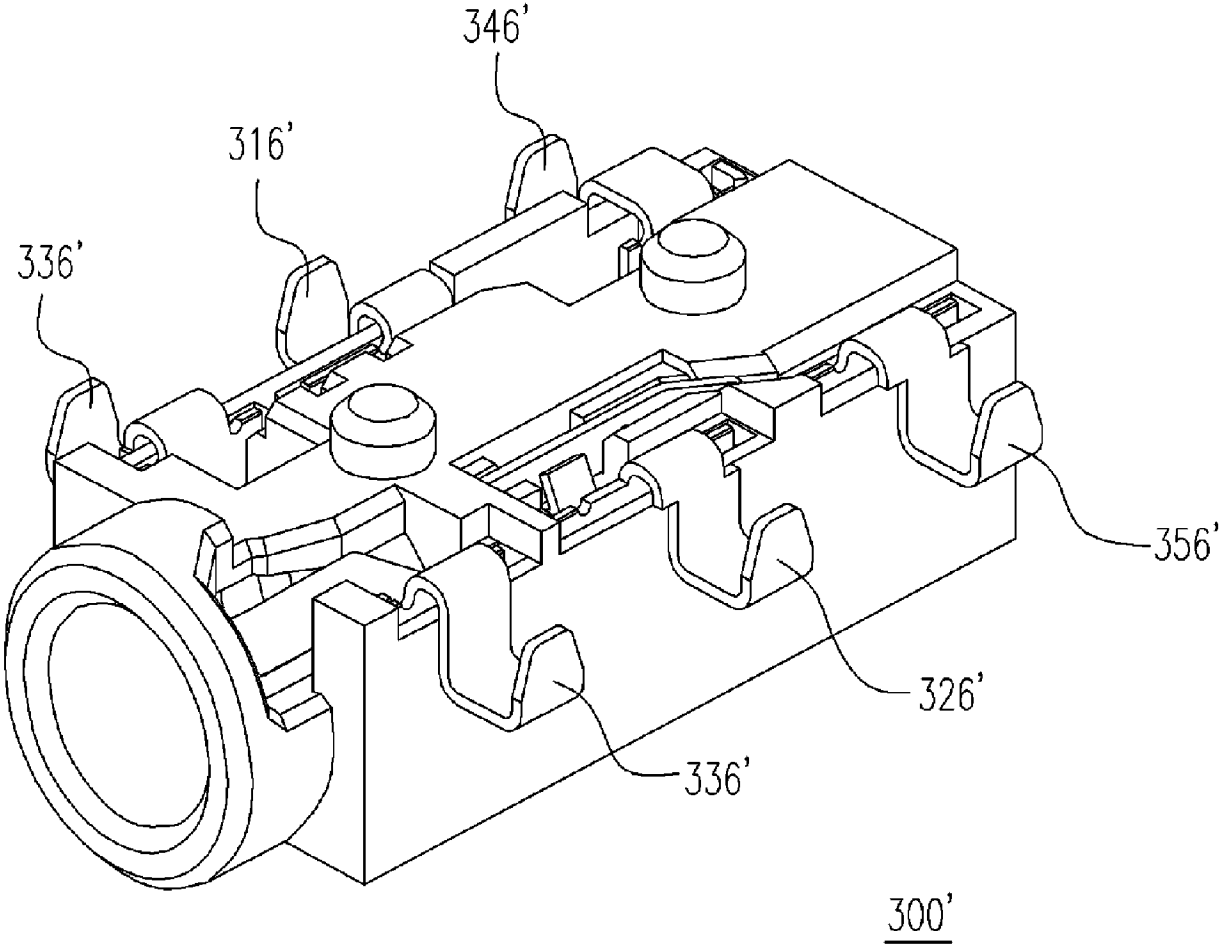
FIG. 7 is a perspective view of another audio jack connector with connecting leads according to one preferred embodiment of the present invention.

Obviously, the present invention has no special requirements for the shape of the leads in the audio jack connector. FIG. 7 is a perspective view of another audio jack connector with connecting leads according to one preferred embodiment of the present invention. Similarly, the audio jack connector 300' can connect electrically with the circuit board inside the electronic product through a plurality of terminal connecting leads 316', 326' and 336' and fixing plate connecting leads 346' and 356'. To listen to the sound messages provided by the electronic product, the user only has to insert the plug 400 (as shown in FIG. 4) of the earphone into the audio jack connector.

Figure 8A:
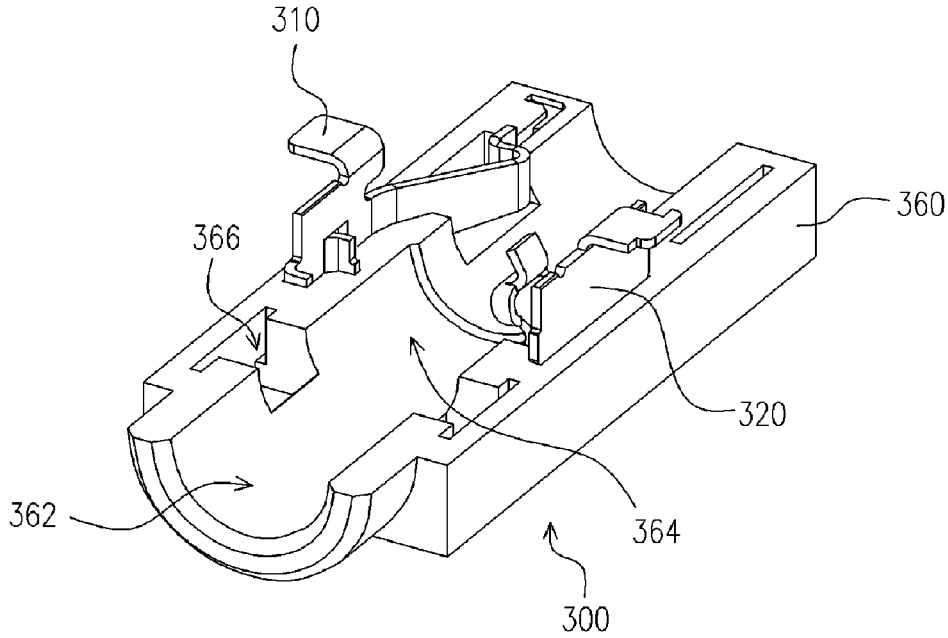
FIGS. 8A through 8D are perspective views showing the steps for assembling the plurality of contact terminals in the insulating housing according to one preferred embodiment of the present invention.
Figure 8B:
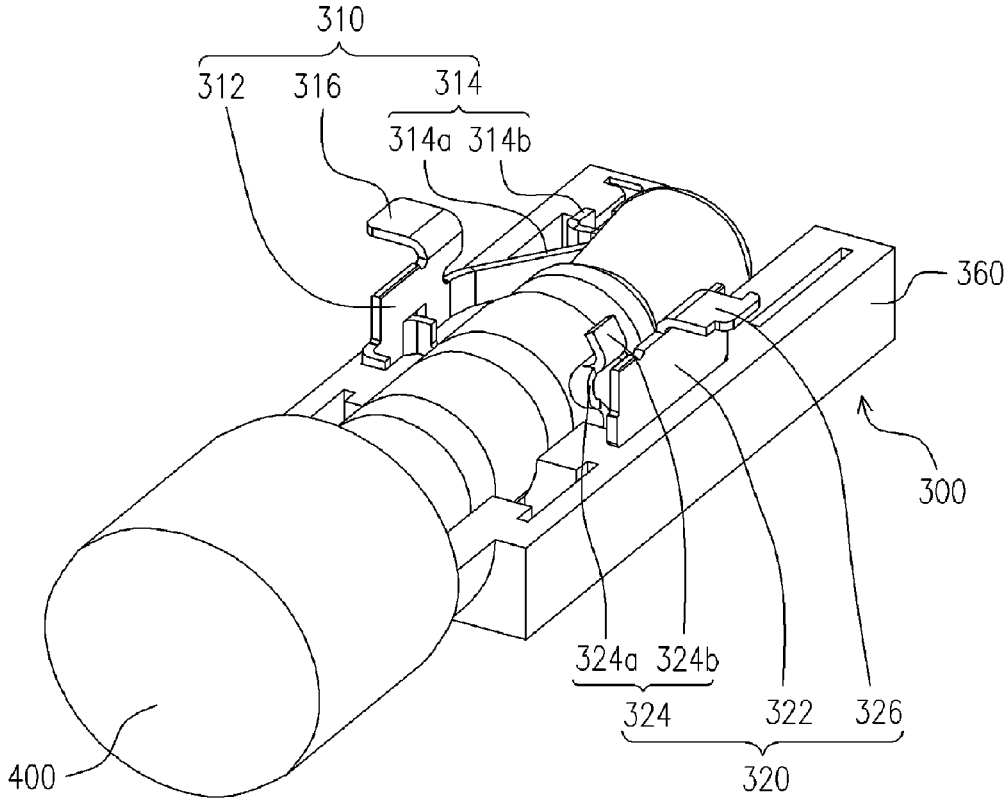

It should be noted that the present invention provides a better structural design for the audio jack connector 300 (or the audio jack connector 300') so that the assembling time is shorter than the convention technique. In the following, the process of assembling the contact terminals to form the audio jack connector 300 is explained as an example. FIGS. 8A through 8D are perspective views showing the steps for assembling the plurality of contact terminals in the insulating housing according to one preferred embodiment of the present invention. First, as shown in FIG. 8A, the first and second contact terminals 310 and 320 are disposed inside a corresponding groove 366 respectively. Then, as shown in FIG. 8B, the plug 400 is inserted into the chamber 364 (as shown in FIG. 8A) of the audio jack connector 300. In the present embodiment, after inserting the plug 400 into the chamber 364, the first and second contact terminals 310 and 320 form an electrical connection with the plug 400. In addition, the plug 400 will push the bending portion 314*a* and the first contact protrusion 324*a* so that the first and second contact portions 314*b* and 324*b* move away from the initial position.

Figure 8C:
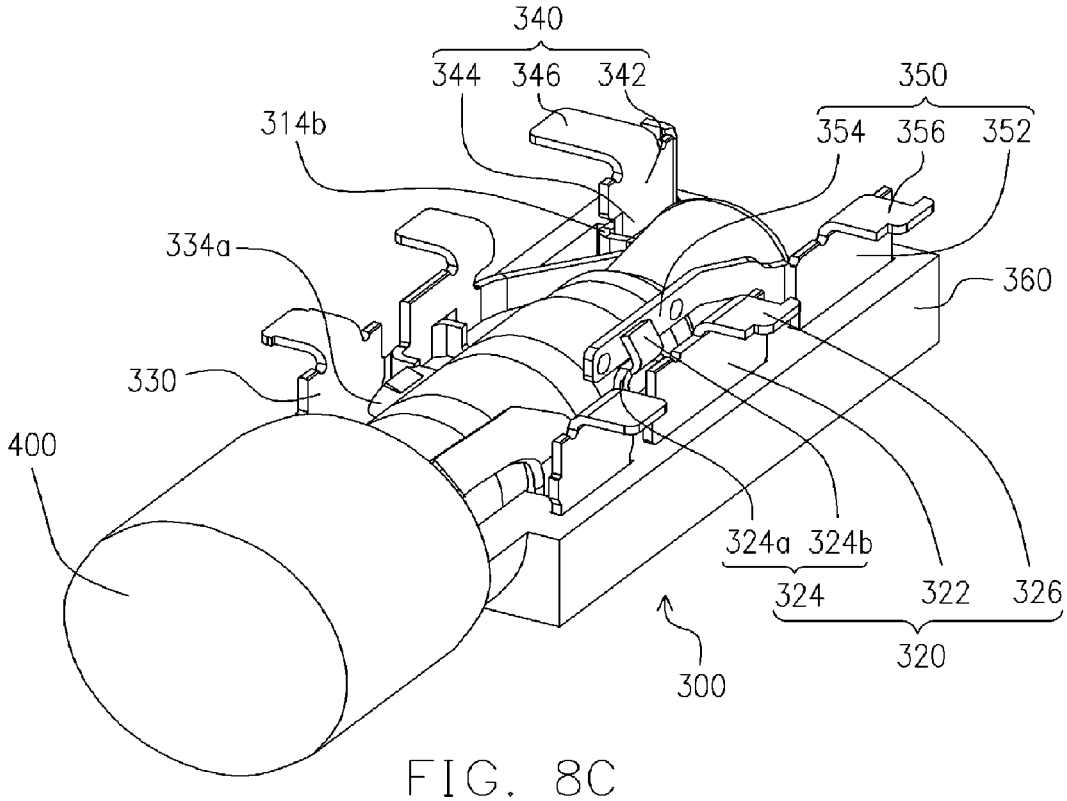
Figure 8D:
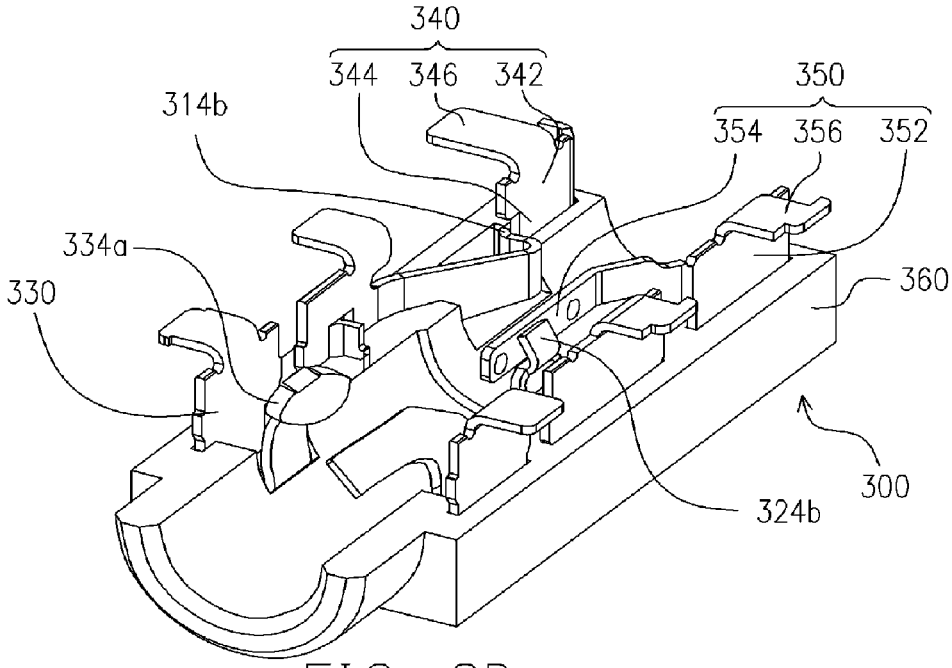

After inserting the plug 400 into the chamber 364, the third contact terminals 330, and the first and second fixing plates 340 and 350 are simultaneously positioned into the grooves 366 (as shown in FIG. 8C). The second contact protrusion 334*a* of the third contact terminals 330 are electrically connected to the plug 400 while the first and second stopping portions 344 and 354 of the first and second fixing plates 340 and 350 are located in the initial position of the first and second contact portions 314*b* and 324*b*. Thereafter, as shown in FIG. 8D, the plug 400 is removed so that the first and second contact portions 314*b* and 324*b* are limited by the outer edge of the first and second stopping portions 344 and 354 on the return path to the initial location. Thus, the process of assembling the contact terminals completed.

To listen to sound messages provided by the electronic product, the plug of the earplug is inserted into the chamber so that the first, second and third contact terminals and the plug are electrically connected. At the same time, the plug will also move the bending portion and the first contact protrusion so that the first and second contact portions move away from the first and second stopping portions. In other words, the first and second contact terminals no longer form an electrical contact with the first and second fixing plates. As a result, the system inside the electronic product can decide whether to initiate the sound transmission process or not according to state of electrical connection between the first and second contact terminals, and the first and second fixing plates. Moreover, the audio information provided by the electronic device can be transmitted to the user through the electrical connection between the first, second and third contact terminals and the plug.

In summary, the audio jack connector of the present invention has an improved structural design, that is, the assembling of the contact terminals to the insulating housing does not require another process to latch the contact terminals to the surface of the insulating housing. Hence, the process of assembling the contact terminals to the insulating housing is very much simplified and the assembling time can be significantly shortened. Furthermore, both the contact terminals and the fixing plates of the audio jack connector are disposed in the grooves on the sidewalls of the chamber. Therefore, the planarity of the connecting leads of the terminals and the fixing plates of the audio jack connector can be adjusted to an optimum state through a fixture. As a result, the connecting lead of each contact terminal and fixing plate can form a good electrical connection with the circuit board inside the electronic product. In other words, the quality of the audio jack connector in the present invention is easier to control so that a higher product yield is possible.

In addition, the contact terminals are fabricated using titanium-copper alloy. Hence, the frequent plugging and pulling of the plug into and out of the chamber will not lead to substantial wear and tear of the contact terminals. That means, even after a large number of plugging and pulling operations, the plug and the contact terminals can still maintain a good contact so that quality signal transmission is possible.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An audio jack connector suitable for engaging with a plug, comprising:

an insulating housing having an inserting hole, a chamber and a plurality of grooves, wherein the inserting hole is connected to the chamber, openings of the grooves are located on a same outer surface of the insulating housing and connected through to the chamber;

a first contact terminal disposed in one of the corresponding grooves;

a second contact terminal disposed in one of the corresponding grooves;

a plurality of third contact terminals disposed in the corresponding grooves;

a first fixing plate disposed in the groove that corresponds to the first contact terminal and electrically connected to the first contact terminal; and a second fixing plate disposed in the groove that corresponds to the second contact terminal and electrically connected to the second contact terminal, wherein after the plug has been inserted into the chamber of through the inserting hole, the first contact terminal, the second contact terminal and the third contact terminals are electrically connected to the plug, and furthermore, the first contact terminal and the second contact terminal detach from the first fixing plate and the second fixing plate respectively.

2. The audio jack connector of claim 1, wherein the first contact terminal further includes:

a first terminal body;

a first spring contact arm extending out from the first terminal body, wherein the first spring contact arm has a bending portion and a first contact portion, the first contact portion is electrically connected to the first fixing plate and the bending portion is disposed within the chamber suitable for contacting the plug; and a first terminal connecting lead bending out from the first terminal body, wherein as the plug is pushed into the chamber through the inserting hole, the plug will push the bending portion to detach the first contact portion from the first fixing plate.

3. The audio jack connector of claim 2, wherein the first terminal body has a latching plate and the insulating housing has a corresponding latching groove such that the latching plate can latch onto the latching groove.

4. The audio jack connector of claim 2, wherein the first fixing plate includes:

a first fixing body;

a first stopping portion extending out from the first fixing body, wherein the first contact portion is limited by an outer edge of the first stopping portion; and a first fixing connecting lead bending out from the first fixing body.

5. The audio jack connector of claim 1, wherein the second contact terminal includes:

a second terminal body;

a second spring contact arm extending out from the second terminal body, wherein the second spring contact arm has a second contact portion and a first contact protrusion, the second contact portion is electrically connected to the second fixing plate, and the first contact protrusion is disposed within the chamber for contacting the plug; and a second terminal connecting lead bending out from the second terminal body, wherein as the plug is pushed into the chamber through the inserting hole, the plug pushes the first contact protrusion so that the second contact portion detaches from the second fixing plate.

6. The audio jack connector of claim 5, wherein the second fixing plate further includes:

a second fixing body; and a second stopping portion extending out from the second fixing body, wherein the second contact portion is limited by the outer edge of the second stopping portion; and a second fixing plate connecting lead bending out from the second fixing body.

7. The audio jack connector of claim 1, wherein each third contact terminal includes:

a third terminal body;

a third spring contact arm extending out from the third terminal body, wherein the third spring contact arm has a second contact protrusion disposed within the chamber suitable for contacting the plug; and a third terminal connecting lead bending out from the third terminal body.

8. The audio jack connector of claim 1, wherein the insulating housing further includes at least an alignment pillar disposed at the bottom of the insulating housing.

9. The audio jack connector of claim 1, wherein a material constituting the first contact terminal, the second contact terminal, the third contact terminal, the first fixing plate and the second fixing plate includes titanium-copper alloy.

* * * * *